US009615656B2

(12) United States Patent
Wang

(10) Patent No.: US 9,615,656 B2
(45) Date of Patent: Apr. 11, 2017

(54) DRIVER FIXING DEVICE FOR ELECTRIC ADJUSTABLE STANDING DESK

(71) Applicant: Chun-Tsair Wang, Taichung (TW)

(72) Inventor: Chun-Tsair Wang, Taichung (TW)

( * ) Notice: Subject to any disclaimer, the term of this patent is extended or adjusted under 35 U.S.C. 154(b) by 0 days.

(21) Appl. No.: 14/884,794

(22) Filed: Oct. 16, 2015

(65) Prior Publication Data

US 2016/0113391 A1 Apr. 28, 2016

(30) Foreign Application Priority Data

Oct. 23, 2014 (TW) ..... 103218830 U

(51) Int. Cl.
*A47B 9/00* (2006.01)
*A47B 9/20* (2006.01)

(52) U.S. Cl.
CPC ..... *A47B 9/20* (2013.01); *A47B 2200/0056* (2013.01)

(58) Field of Classification Search
CPC ..... A47B 9/20; A47B 2200/0056
USPC ..... 248/605, 634, 188.1; 108/500.1, 50.11, 108/147; 74/416, 417; 340/309.16
See application file for complete search history.

(56) References Cited

U.S. PATENT DOCUMENTS 4,711,184 A * 12/1987 Wallin ..... A47B 9/10 108/147
5,259,326 A * 11/1993 Borgman ..... A47B 9/00 108/147
6,286,441 B1 * 9/2001 Burdi ..... A47B 9/00 108/147
6,595,144 B1 * 7/2003 Doyle ..... A47B 9/00 108/147
7,789,025 B2 * 9/2010 Michaud, II ..... A47B 17/02 108/147
8,947,215 B2 * 2/2015 Mandel ..... G06Q 10/109 108/147
9,084,475 B2 * 7/2015 Hjelm ..... A47B 9/00
9,271,567 B2 * 3/2016 Wu ..... A47B 3/002
2014/0096706 A1 * 4/2014 Labrosse ..... A47B 21/02 108/21
2016/0128467 A1 * 5/2016 Sigal ..... A47B 9/00 700/275
2016/0255950 A1 * 9/2016 Mata Valdes ..... A47B 9/20

* cited by examiner

*Primary Examiner* — Anita M King

(74) *Attorney, Agent, or Firm* — Wang Law Firm, Inc.

(57) ABSTRACT

A driver fixing device for an electric adjustable standing desk is provided. The driver fixing device includes a driver, a device framework and a fixing unit. The driver is used for driving the electric adjustable standing desk to ascend and descend, the device framework is arranged around the electric adjustable standing desk, the fixing unit is arranged in the device framework, the fixing unit can be made of an elastic material with a through hole, and the driver penetrates through and is fixed in the through hole. When the driver actuates, the fixing unit allows the driver to slide and move in the through hole for properly regulating a transmission error of the driver, and further, the configuration of a flexible connector is reduced.

5 Claims, 3 Drawing Sheets

DRIVER FIXING DEVICE FOR ELECTRIC ADJUSTABLE STANDING DESK

CROSS-REFERENCE TO RELATED APPLICATION

This application claims priority from Taiwan Patent Application No. 103218830, filed on Oct. 23, 2014, in the Taiwan Intellectual Property Office, the content of which is hereby incorporated by reference in their entirety for all purposes.

BACKGROUND OF THE INVENTION

1. Field of the Invention

This application relates to a driver fixing device, and more particularly, to a driver fixing device which is feasible to be applied to an electric adjustable standing desk.

2. Description of the Related Art

At present, the electric adjustable standing desks are designed to vary with the user's height and body size, and because of the development of related manufacturing technology is mature, the price has gradually declined to the extent accepted by the public.

However, the conventional electric adjustable standing desks are designed with two telescopic columns to adjust the height of the desk top. As to the driver, it is configured as an independent driving mode. Two drivers are applied to respectively drive the telescopic columns to have a linear scaling adjustment; however, an integrated device is necessary to simultaneously drive an adjustment process of the telescopic columns so as to prevent the difference of the adjustment process from causing displacement and inclination to the desk top. Alternatively, a linking-up mode, which only needs single driver and lead screw to transfer the driving power so as to simultaneously drive the two telescopic columns to move, is applied. Although the foregoing modes can reduce the amount of the drivers, it takes more needs to the assembly tolerance of the related components.

When two telescopic columns are driven, a minor transmission error of the driver produces due to the assembly tolerance, and it has to further dispose with a flexible connector to resolve the technical problem. Besides, the operation noise of the device is incapable of being resolved.

In conclusion, the inventor of the present disclosure has been mulling it over, and therefore designs a driver fixing device which is feasible to be applied to an electric adjustable standing desk, so as to improve the current drawbacks and to promote the industrial applicability.

SUMMARY OF THE INVENTION

In view of the foregoing technical problems, the primary objective of the present disclosure provides a driver fixing device for an electric adjustable standing desk which applies a fixing unit made of an elastic material to absorb the minor vibration resulted from the operation of the driver so as to reduce the noise.

In view of the foregoing technical problems, one objective of the present disclosure provides a driver fixing device for an electric adjustable standing desk which applies the gap between the through hole and the driver to allow the driver producing a minor movement so as to reduce the configuration of a flexible connector.

In view of the foregoing technical problems, the other objective of the present disclosure provides a driver fixing device for an electric adjustable standing desk which further simultaneously drive a plurality of telescopic columns of the electric adjustable standing desk by a branching transfer mechanism to reduce the necessary amount of flexible connectors.

In accordance with the aforementioned objective, the present disclosure provides a driver fixing device for an electric adjustable standing desk, which may include a driver, a device framework and a fixing unit. The driver may drive the electric adjustable standing desk ascending and descending. The device framework may be arranged around the electric adjustable standing desk. The fixing unit may be arranged in the device framework and may be made of an elastic material with a through hole and the driver may penetrate through and may be fixed in the through hole. When the driver actuates, the fixing unit may allow the driver to slide and move in the through hole for properly regulating a transmission error of the driver, and further, a configuration of a flexible connector may be reduced.

Preferably, the driver fixing device for an electric adjustable standing desk may further include a position limiting unit arranged in the device framework and in front of the driver to limit a range of movement of the driver.

Preferably, the position limiting unit may further include a buffering part preventing the driver from directly contacting with the position limiting unit.

Preferably, a shape of the through hole may correspond to an external shape of the driver.

Preferably, the driver may further include a branching transfer mechanism transferring power in different axial directions.

Preferably, the branching transfer mechanism may include a worm gear set, a bevel gear set or a combination thereof.

Preferably, the driver fixing device for an electric adjustable standing desk may further include a control unit controlling an operation of the driver.

The primary objective of the present disclosure is to provide a driver fixing device for an electric adjustable standing desk which may have one or more advantages as follows.

1. To reduce the element configuration: by means of the gap between the fixing unit and the driver and allowing the driver to produce a minor movement in the through hole, it is capable of effectively reducing a transmission error of the driver, and further, a configuration of a flexible connector is reduced.

2. To reduce the operation noise: by means of the fixing unit made of an elastic material, it is capable of absorbing the minor vibration resulted from the operation of the driver. In addition, a deformation amount of the elastic material of the fixing unit is able to reduce the operation noise of the device.

3. To reduce the assembling components: by means of the limiting unit and the fixing unit to limit the range of movement of the drive and breaking the traditional thinking of the drive not being fixed on the frame, it is capable of significantly reducing the demand for screws and other assembly components so as to reduce stock costs.

4. To shorten the assembly time: as the demand for assembling components is reduced, it does not need to spend a lot of time on calibrating assemblies one by one during assembly process, such that the assembly time is effectively shortened.

5. To reduce the costs: allowing the driver sliding and moving, it can reduce the assembly time effectively with respect to the configuration of the related components to really reduce the costs associated with the manufacture, preparation, assembly, and further to solve the noise problem.

With these and other objects, advantages, and features of the disclosure that may become hereinafter apparent, the nature of the disclosure may be more clearly understood by reference to the detailed description of the disclosure, the embodiments and to the several drawings herein.

DETAILED DESCRIPTION OF THE PREFERRED EMBODIMENTS

Hereinafter, embodiments of the present disclosure will be described in detail with reference to the accompanying drawings so that those skilled in the art to which the present disclosure pertains can realize the present disclosure. As those skilled in the art would realize, the described embodiments may be modified in various different ways, all without departing from the spirit or scope of the present disclosure.

The exemplary embodiments of the present disclosure will be understood more fully from the detailed description given below and from the accompanying drawings of various embodiments of the disclosure, which, however, should not be taken to limit the disclosure to the specific embodiments, but are for explanation and understanding only.

Figure 1:
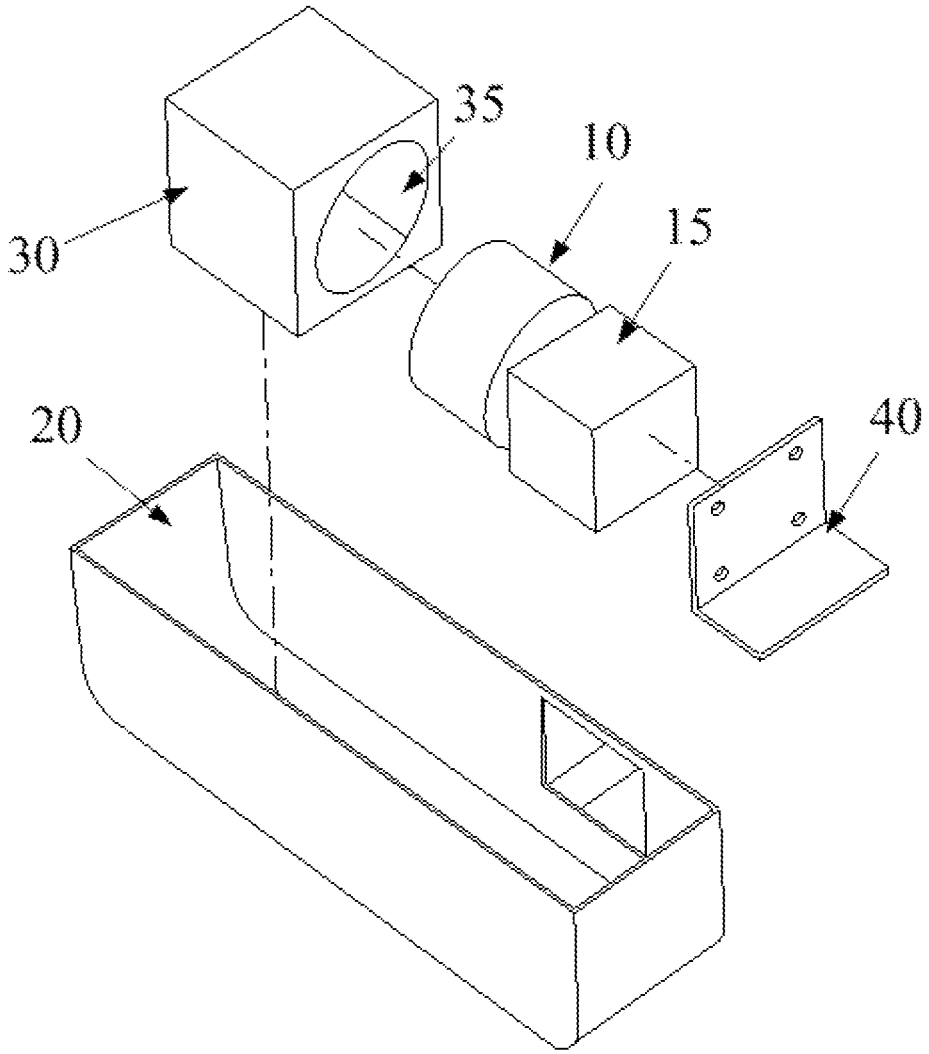
FIG. 1 is a schematic diagram of a driver fixing device for an electric adjustable standing desk of the present disclosure.
Figure 2:
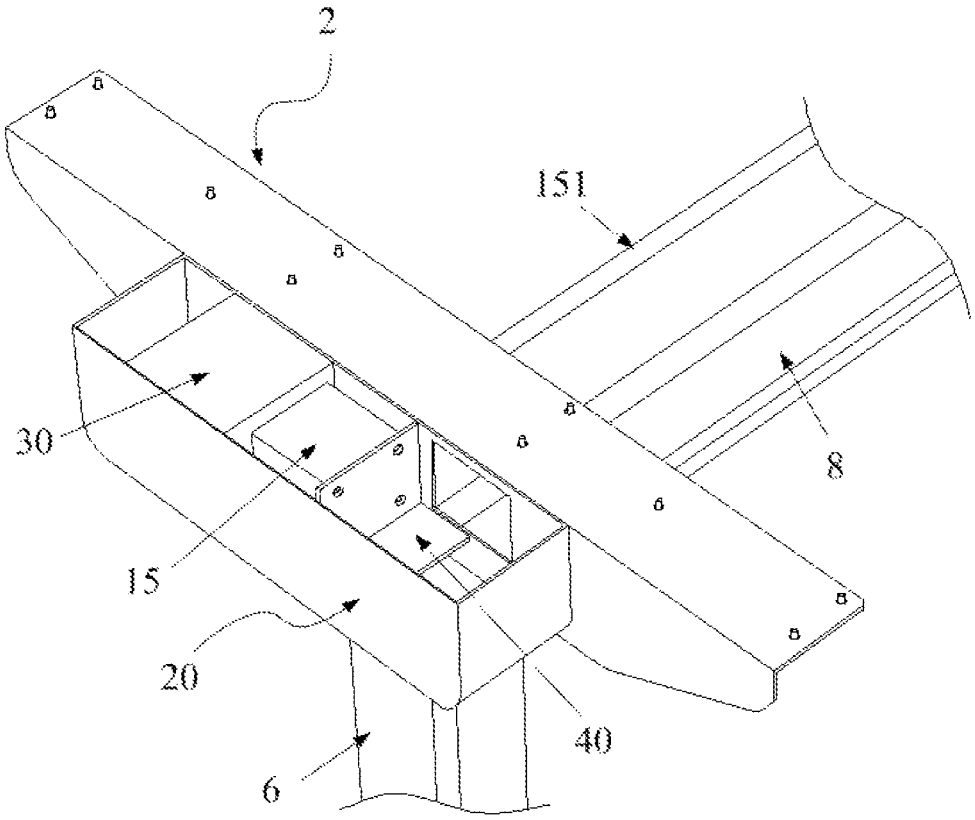
FIG. 2 is a layout diagram of a driver fixing device for an electric adjustable standing desk of the present disclosure.
Figure 3:
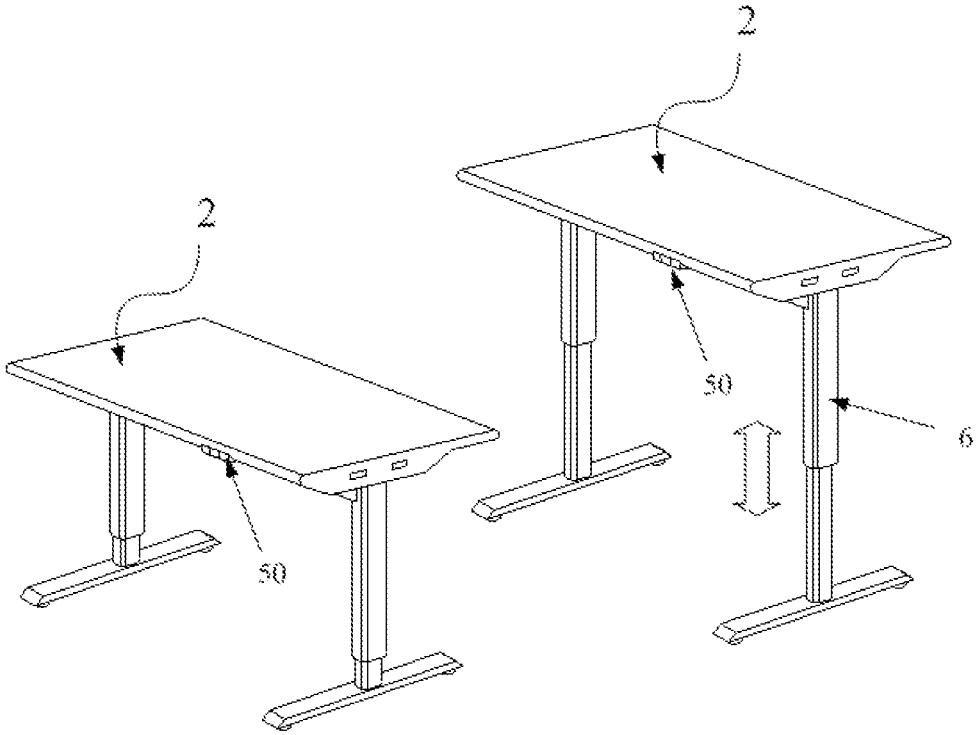
FIG. 3 is a schematic diagram showing the application of a driver fixing device for an electric adjustable standing desk of the present disclosure.

Please refer to FIG. 1, FIG. 2 and FIG. 3 together. FIG. 1 is a schematic diagram of a driver fixing device for an electric adjustable standing desk of the present disclosure. FIG. 2 is a layout diagram of a driver fixing device for an electric adjustable standing desk of the present disclosure. FIG. 3 is a schematic diagram showing the application of a driver fixing device for an electric adjustable standing desk of the present disclosure. As shown in the figures, an adjustable standing desk 2 is at least assembled by a telescopic column 6, a connecting rail 8 and a desk top. Two telescopic columns 6 are assembled symmetrically at two sides of the connecting rail 8 and the desk top is arranged over the two telescopic columns 6, such that when adjusting the height of the two telescopic columns 6, the desk top can fit into the height simultaneously.

The driver fixing device includes a driver 10, a device framework 20 and a fixing unit 30. The driver 10 drives the adjustable standing desk 2 ascending and descending. The device framework 20 is arranged around the adjustable standing desk 2. The fixing unit 30 is made of an elastic material with a through hole 35. In practice, a shape of the through hole 35 corresponds to an external shape of the driver 10, and the driver 10 penetrates through and is fixed in the through hole 35.

When the driver 10 actuates, the fixing unit 30 allows the driver 10 to slide and move in the through hole 35 for properly regulating a transmission error of the driver 10, and further, a configuration of a flexible connector is reduced. In addition, a deformation amount of the elastic material of the fixing unit 30 is able to reduce the operation noise of the device.

In practice, the driver fixing device further includes a position limiting unit 40. The position limiting unit 40 may be an L-shape block and is arranged in the device framework 20 and in front of the driver 10. A distance between the fixing unit 30 and the position limiting unit 40 is adjusted based on the size of the driver 10 to limit a range of movement of the driver 10. Furthermore, the position limiting unit 40 can be further disposed with a buffering part which is a foam, a spring, and so on to prevent the driver 10 from directly contacting with the position limiting unit 40 in the operation process. To be more process, the position limiting unit 40 is used as a limit switch. When the adjustable standing desk 2 descends to a limit position, the driver 10 contacts with the position limiting unit 40 in the process of moving, the driver 10 produces an overcurrent signal to control the driver 10 to stop so as to protect the process safely.

In practice, when a single driver 10 is applied to drive two telescopic columns 6, the driver 10 is connected to a branching transfer mechanism 15 which is a worm gear set or a bevel gear set to transfer power in different axial directions, but it shall be not limited thereto. As shown in FIG. 2, a lead screw 151 cooperates with the branching transfer mechanism 15 to transfer the power of the driver 10 to the two telescopic columns 6 assembled symmetrically at two sides of the adjustable standing desk 2 so as to simultaneously drive the two telescopic columns 6 ascending and descending. The driver fixing device further includes a control unit 50 to control the ascension and descent of the adjustable standing desk 2.

Specifically, according to the different usage states, the user can adjust the height of the telescopic column 6 to fit into the different situations of the working environment. For example, the adjustable standing desk 2 varies with the sitting position or standing position of the user. By means of controlling the control unit 50 to fit into the height of the telescopic column 6, the user can have an optimal height according to the personal habit so as to promote the work efficiency.

By means of the gap between the fixing unit and the driver and allowing the driver to produce a minor movement in the through hole, it is capable of effectively reducing a transmission error of the driver, and further, a configuration of a flexible connector is reduced. Furthermore, since the drive is not fully secured to the frame, so that a minor displacement quantity is applied to compensate the transmission error of the driver resulted from the assembly tolerance in the process of the power transfer. Furthermore, because the driver is not fixed to the frame, it is capable of significantly reducing the demand for screws and other assembly components so as to reduce stock costs. In addition, it does not need to spend a lot of time on calibrating assemblies one by one during assembly process so as to effectively shorten the assembly time, and can also reduce the assembly time effectively with respect to the configuration of the related components to really reduce the costs associated with the manufacture, preparation, assembly, and further to solve the noise problem.

While the means of specific embodiments in present disclosure has been described by reference drawings, numerous modifications and variations could be made thereto by those skilled in the art without departing from the scope and spirit of the disclosure set forth in the claims. The modifications and variations should in a range limited by the specification of the present disclosure.

What is claimed is:

1. A driver fixing device for an electric adjustable standing desk, comprising:

a driver driving the electric adjustable standing desk in an ascending direction and a descending direction, a device framework arranged around the electric adjustable standing desk, and a fixing unit arranged in the device framework and made of an elastic material with a through hole, and the driver penetrating through and fixed in the through hole;

wherein, when the driver actuates, the fixing unit allows the driver to slide and move in the through hole for properly regulating a transmission error of the driver, and further, a configuration of a flexible connector is reduced.

2. The driver fixing device for an electric adjustable standing desk of claim 1, further comprising a position limiting unit arranged in the device framework and in front of the driver to limit a range of movement of the driver.

3. The driver fixing device for an electric adjustable standing desk of claim 1, wherein a shape of the through hole corresponds to an external shape of the driver.

4. The driver fixing device for an electric adjustable standing desk of claim 1, wherein the driver further comprises a branching transfer mechanism transferring power in different axial directions.

5. The driver fixing device for an electric adjustable standing desk of claim 1, further comprising a control unit controlling an operation of the driver.

* * * * *